US011054769B2

(12) United States Patent
Shimada

(10) Patent No.: US 11,054,769 B2
(45) Date of Patent: Jul. 6, 2021

(54) FIXING DEVICE AND IMAGE FORMING APPARATUS INCORPORATING SAME

(71) Applicant: Hiroyuki Shimada, Tokyo (JP)

(72) Inventor: Hiroyuki Shimada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/923,157

(22) Filed: Jul. 8, 2020

(65) Prior Publication Data

US 2021/0041811 A1 Feb. 11, 2021

(30) Foreign Application Priority Data

Aug. 9, 2019 (JP) ..... JP2019-147504

(51) Int. Cl.
*G03G 15/20* (2006.01)

(52) U.S. Cl.
CPC ..... *G03G 15/2025* (2013.01)

(58) Field of Classification Search
CPC ..... G03G 15/2025
See application file for complete search history.

(56) References Cited

U.S. PATENT DOCUMENTS

2011/0052245 A1 3/2011 Shinshi et al.
2014/0341623 A1* 11/2014 Arai ..... G03G 15/2053 399/329
2017/0176899 A1 6/2017 Okamoto et al.
2018/0203384 A1* 7/2018 Okamoto ..... G03G 15/2053
2018/0373187 A1* 12/2018 Ikebuchi ..... G03G 15/2025
2020/0033777 A1 1/2020 Fujimoto et al.
2020/0209787 A1* 7/2020 Taniguchi ..... G03G 15/2025

FOREIGN PATENT DOCUMENTS

JP 2007-057851 3/2007
JP 2011-053380 3/2011
JP 2012-118225 6/2012
JP 2014-174434 9/2014
JP 2017-111333 6/2017

* cited by examiner

*Primary Examiner* — Carla J Therrien

(74) *Attorney, Agent, or Firm* — Oblon, McClelland, Maier & Neustadt, L.L.P.

(57) ABSTRACT

A fixing device includes a flexible endless belt, a pressure rotator disposed outside the belt and facing the belt, a nip formation pad disposed inside a loop of the belt and configured to form a fixing nip between the belt and the pressure rotator, a heater configured to heat the belt, a flange configured to support an end portion of the belt, a first lubricant, and a second lubricant. The first lubricant is applied between the nip formation pad and an inner surface of the belt. The second lubricant is applied between the flange and the inner surface of the belt. The second lubricant has a temperature characteristic different from a temperature characteristic of the first lubricant.

4 Claims, 4 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119 to Japanese Patent Application No. 2019-147504, filed on Aug. 9, 2019 in the Japan Patent Office, the entire disclosure of which is hereby incorporated by reference herein.

BACKGROUND

Technical Field

Embodiments of this disclosure generally relate to a fixing device to fix a toner image onto a recording medium such as a sheet by heat and pressure and an image forming apparatus such as a copier, a printer, or a facsimile machine, incorporating the fixing device.

Background Art

Image forming apparatuses such as a copier, a printer, a facsimile machine, or a multifunctional machine having two or more of copying, printing, and facsimile functions, employing an electrophotographic system include a fixing device to fix a toner image formed by an electrophotographic method onto a recording medium.

In such a fixing device, a heater disposed inside a loop of an endless fixing belt heats the fixing belt sandwiched between a nip formation pad and a pressure roller.

SUMMARY

This specification describes an improved fixing device that includes a flexible endless belt, a pressure rotator disposed outside the belt and facing the belt, a nip formation pad disposed inside a loop of the belt and configured to form a fixing nip between the belt and the pressure rotator, a heater configured to heat the belt, a flange configured to support an end portion of the belt, a first lubricant, and a second lubricant.

The first lubricant is applied between the nip formation pad and an inner surface of the belt. The second lubricant is applied between the flange and the inner surface of the belt. The second lubricant has a temperature characteristic different from a temperature characteristic of the first lubricant.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
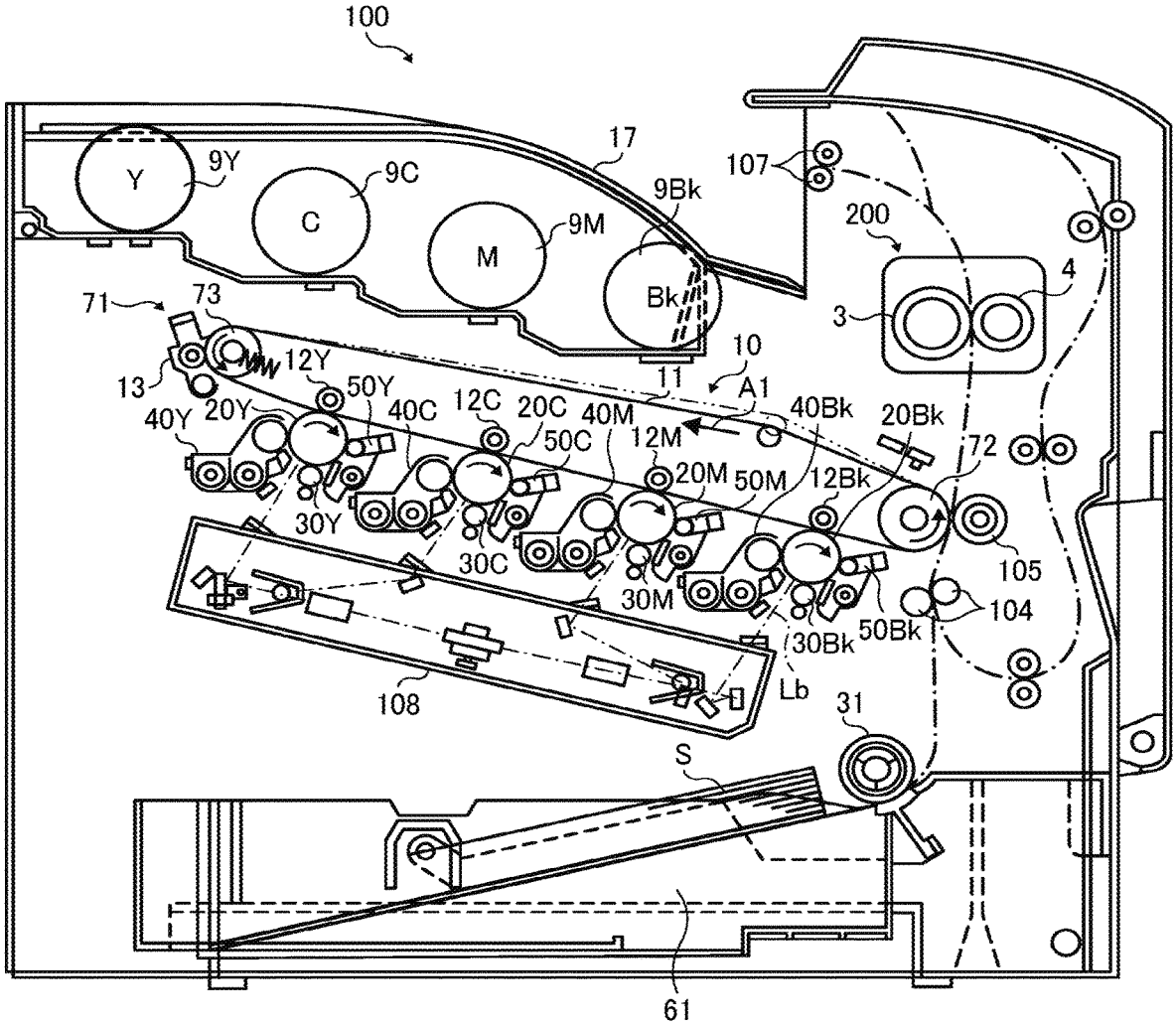
FIG. 1 is a schematic view illustrating a configuration of an image forming apparatus including a fixing device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

A description is provided of a fixing device according to the present disclosure and an image forming apparatus incorporating the fixing device with reference to drawings.

The image forming apparatus 100 illustrated in FIG. 1 is a color printer employing a tandem system in which a plurality of image forming devices for forming toner images in a plurality of colors, respectively, is aligned. Alternatively, the image forming apparatus 100 may employ other systems and may be a copier, a facsimile machine, a printer, a multifunction peripheral or a multifunction printer (MFP) having at least one of copying, printing, scanning, facsimile, and plotter functions, or the like.

As illustrated in FIG. 1, the image forming apparatus 100 according to the present embodiment employs a tandem structure in which photoconductor drums 20Y, 20C, 20M, and 20Bk are arranged side by side as image bearers that bear yellow, cyan, magenta, and black toner images in separation colors, respectively.

The image forming apparatus 100 includes the four image forming devices that perform image forming processes for yellow, cyan, magenta, and black, a transfer belt unit 10, a secondary transfer roller 105, a belt cleaner 13, and the optical writing device 108. The transfer belt unit 10 is situated above and disposed opposite the photoconductor drums 20Y, 20C, 20M, and 20Bk. The transfer belt unit 10 incorporates the transfer belt 11 and the primary transfer rollers 12Y, 12C, 12M, and 12Bk. The secondary transfer roller 105 is disposed opposite the transfer belt 11 and driven and rotated in accordance with rotation of the transfer belt 11. The belt cleaner 13 is disposed opposite the transfer belt 11 to clean the transfer belt 11. The optical writing device 108 is situated below and disposed opposite the four image forming devices.

The image forming apparatus 100 further includes a sheet feeder 61 and a registration roller pair 104. The sheet feeder 61 incorporates a sheet tray that loads a plurality of recording media S to be conveyed to a secondary transfer nip formed between the transfer belt 11 and the secondary transfer roller 105. The registration roller pair 104 conveys a recording medium S conveyed from the sheet feeder 61 to the secondary transfer nip formed between the transfer belt 11 and the secondary transfer roller 105 at a predetermined time when the yellow, cyan, magenta, and black toner images superimposed on the transfer belt 11 reach the secondary transfer nip. The image forming apparatus 100 further includes a sensor that detects a leading edge of the recording medium S as it reaches the registration roller pair 104.

The image forming apparatus 100 further includes a fixing device 200, an output roller pair 107, an output tray 17, and toner bottles 9Y, 9C, 9M, and 9Bk. The fixing device 200 as a fixing unit employing a belt fixing system fixes a color toner image formed by the yellow, cyan, magenta, and black toner images secondarily transferred from the transfer belt 11 onto the recording medium S thereon. The output roller pair 107 ejects the recording medium S bearing the fixed toner image onto an outside of the image forming apparatus 100, that is, the output tray 17. The output tray 17 is disposed atop the image forming apparatus 100 and stacks the recording medium S ejected by the output roller pair 107 to the outside of the image forming apparatus 100. The toner bottles 9Y, 9C, 9M, and 9Bk are situated below the output tray 17 and replenished with fresh yellow, cyan, magenta, and black toners, respectively.

In the image forming apparatus 100, the yellow, cyan, magenta, and black toner images formed on the photoconductor drums 20Y, 20C, 20M, and 20Bk, respectively, as visible images are primarily transferred successively onto a transfer belt 11, that is, an endless belt serving as an intermediate transferor, disposed opposite the photoconductor drums 20Y, 20C, 20M, and 20Bk as the transfer belt 11 rotates in a rotation direction A1 in a primary transfer process. Through the primary transfer process, the yellow, cyan, magenta, and black toner images are superimposed on the transfer belt 11 and then secondarily transferred onto the recording medium S such as a sheet collectively in a secondary transfer process.

Each of the photoconductor drums 20Y, 20C, 20M, and 20Bk is surrounded by image forming components that form the yellow, cyan, magenta, and black toner images on the photoconductor drums 20Y, 20C, 20M, and 20Bk as they rotate clockwise in FIG. 1. Taking the photoconductor drum 20Bk that forms the black toner image, the following describes an image forming operation to form the black toner image. The photoconductor drum 20Bk is surrounded by a charger 30Bk, a developing device 40Bk, a primary transfer roller 12Bk, and a cleaner 50Bk in this order in a rotation direction of the photoconductor drum 20Bk. The photoconductor drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in their rotation directions of the photoconductor drums 20Y, 20C, and 20M, respectively. After the charger 30Bk charges the photoconductor drum 20Bk, an optical writing device 108 writes an electrostatic latent image on the photoconductor drum 20Bk with a laser beam Lb.

As the transfer belt 11 rotates in the direction of rotation A1, the yellow, cyan, magenta, and black toner images formed as visible images on the photoconductor drums 20Y, 20C, 20M, and 20Bk, respectively, are primarily transferred onto the transfer belt 11 such that the yellow, cyan, magenta, and black toner images are superimposed one atop another on the transfer belt 11. In the primary transfer process, the primary transfer rollers 12Y, 12C, 12M, and 12Bk disposed opposite the photoconductor drums 20Y, 20C, 20M, and 20Bk via the transfer belt 11, respectively, apply a primary transfer bias to the photoconductor drums 20Y, 20C, 20M, and 20Bk successively from the upstream photoconductor drum 20Y to the downstream photoconductor drum 20Bk in the rotation direction A1 of the transfer belt 11.

In the present embodiment, the photoconductor drums 20Y, 20C, 20M, and 20Bk are aligned in this order in the rotation direction A1 of the transfer belt 11. The photoconductor drums 20Y, 20C, 20M, and 20Bk are located in four image forming devices that form the yellow, cyan, magenta, and black toner images, respectively.

The optical writing device 108 includes a semiconductor laser as a light source, a coupling lens, an fθ lens, a troidal lens, a deflection mirror, and a rotatable polygon mirror as a deflector.

The optical writing device 108 emits light beams Lb corresponding to the yellow, cyan, magenta, and black toner images to be formed on the photoconductor drums 20Y, 20C, 20M, and 20Bk thereto, forming electrostatic latent images on the photoconductor drums 20Y, 20C, 20M, and 20Bk, respectively. FIG. 1 illustrates the light beam Lb irradiating the photoconductor drum 20Bk. Similarly, light beams Lb irradiate the photoconductor drums 20Y, 20C, and 20M, respectively.

The transfer belt unit 10 includes a drive roller 72 and a driven roller 73 around which the transfer belt 11 is wound, in addition to the transfer belt 11 and the primary transfer rollers 12Y, 12C, 12M, and 12Bk.

Since the driven roller 73 also serves as a tension applicator that applies tension to the transfer belt 11, a biasing member (e.g., a spring) biases the driven roller 73 against the transfer belt 11. A transfer device 71 includes the transfer belt unit 10, the primary transfer rollers 12Y, 12C, 12M, and 12Bk, the secondary transfer roller 5, and the belt cleaner 13.

The sheet feeder 61 is situated in a lower portion of the image forming apparatus 100 and includes a feed roller 31 that contacts an upper side of an uppermost recording medium S of the plurality of recording media S loaded on the sheet tray of the sheet feeder 61. As the feed roller 31 is driven and rotated counterclockwise in FIG. 1, the feed roller 31 feeds the uppermost recording medium S to the registration roller pair 104.

The belt cleaner 13 in the transfer device 71 includes a cleaning brush and a cleaning blade disposed to face and contact the transfer belt 11. The cleaning brush and the cleaning blade in the belt cleaner 13 scrape a foreign substance such as residual toner off the transfer belt 11, removing the foreign substance from the transfer belt 11 and thereby cleaning the transfer belt 11. The belt cleaner 13 further includes a waste toner conveyer that conveys and discards the residual toner removed from the transfer belt 11.

The image forming apparatus 100 includes, for example, a control panel on the top of the body. The control panel includes a touch panel, various keys, etc., and a user can operate these tools to input various commands relating to, for example, selection of a desired function and various settings related to the function.

For example, the user uses the control panel to select a copy function, a copy size, and a number of copies and performs a copy start operation. When the copy start operation is performed, the image forming apparatus 100 performs an electrophotographic process control while the sheet tray in the sheet feeder 61 corresponding to the selected copy size feeds the recording medium S. An electrophotographic process forms a multicolor superimposed toner image, primarily transfers the multicolor superimposed toner image onto the transfer belt 11, and secondarily transfers the multicolor superimposed toner image onto the recording medium S. The image forming apparatus 100 repeatedly performs this image formation process for the number of copies.

After the toner image is transferred onto the recording medium S in the image formation process, the fixing device 200 applies heat and pressure to the toner image on the upper surface of the recording medium S and fixes the toner image onto the recording medium S when the recording medium S passes through the fixing device 200, and the recording medium S is ejected to the output tray 17.

Next, descriptions are given below of a schematic configuration of the fixing device 200 according to the present embodiment with reference to FIG. 2.

Figure 2:
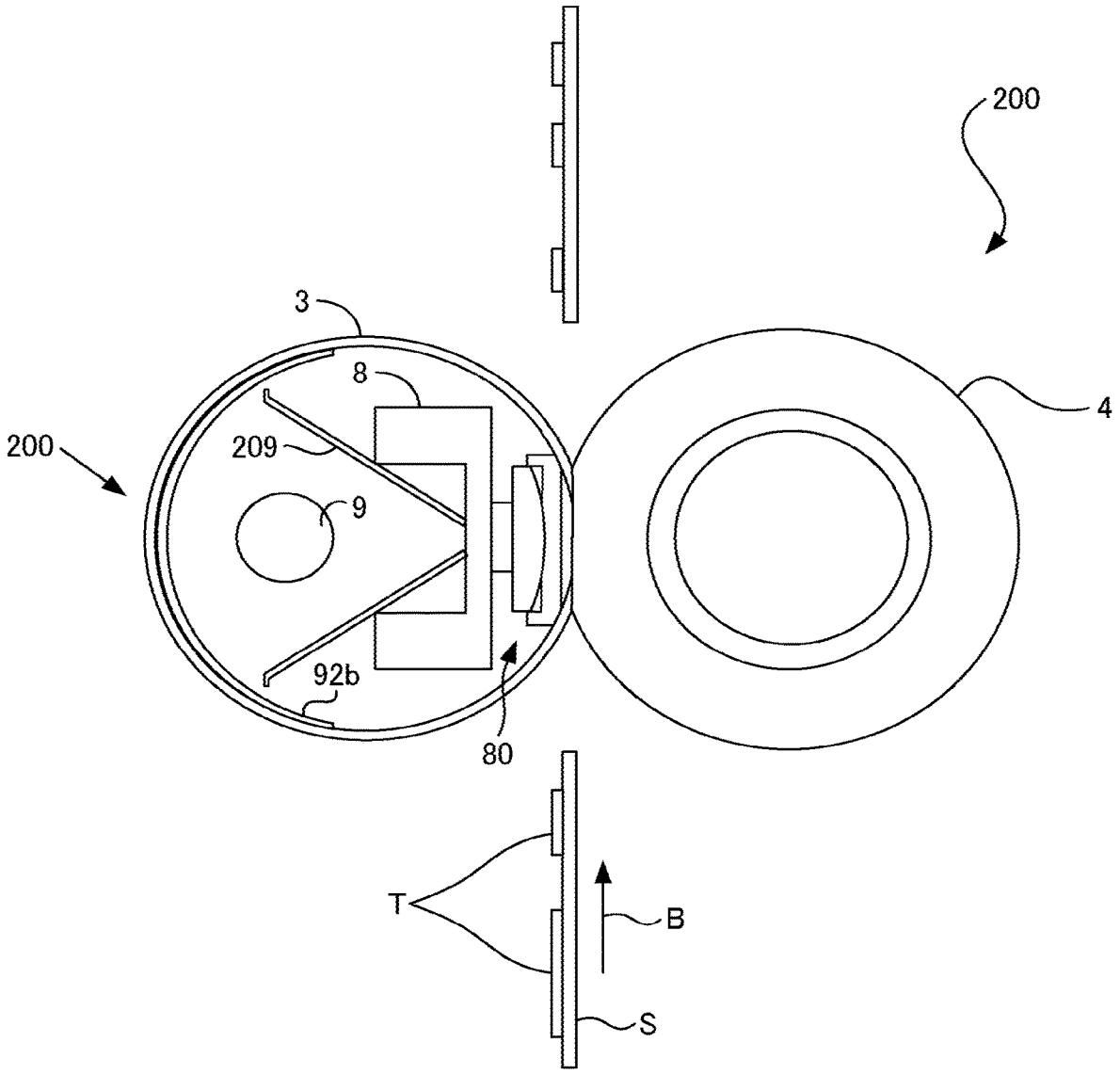
FIG. 2 is a cross-sectional view of the fixing device of the image forming apparatus according to the embodiment of the present disclosure.

As illustrated in FIG. 2, the fixing device 200 includes a fixing belt 3 that is a fixing rotator and a flexible endless belt and a pressure roller 4 as a pressure rotator disposed outside the fixing belt 3 and facing the fixing belt 3. The fixing device 200 also includes a halogen heater 9 as a heat source to heat the fixing belt 3 and a nip formation pad 80 that is disposed inside a loop of the fixing belt 3 and sandwiches the fixing belt 3 together with the pressure roller 4 to form a fixing nip. The recording medium S bearing the toner image passes through the fixing nip formed between the fixing belt 3 and the pressure roller 4 in a direction indicated by arrow B in FIG. 2, and heat and pressure is applied to the recording medium S to fix the toner image.

A base of the fixing belt 3 is an endless belt or film made of a metal material, such as nickel or stainless steel (e.g., steel use stainless or SUS), or a resin material such as polyimide. A surface layer of the fixing belt 3 has a release layer. The release layer is made of perfluoroalkoxy alkane (PFA), polytetrafluoroethylene (PTFE), or the like to facilitate separation of toner of the toner image on the sheet P from the fixing belt 3, thus preventing the toner of the toner image from adhering to the fixing belt 3. The fixing belt 3 may include an elastic layer sandwiched between the base and the release layer and made of silicone rubber or the like. The fixing belt 3 that does not incorporate the elastic layer made of silicone rubber has a small thermal capacity that improves fixing property of being heated quickly to a desired fixing temperature at which the toner image is fixed on the recording medium S. However, as the fixing belt 3 presses the unfixed toner image on the recording medium S, slight surface asperities in the fixing belt 3 are transferred onto the toner image on the recording medium S, resulting in variation in gloss of the solid toner image that may appear as an orange peel image on the recording medium S. To eliminate the variation in gloss, preferably, the elastic layer made of silicone rubber has a thickness not smaller than 100 μm. Deformation of the elastic layer made of silicone rubber and having the thickness not smaller than 100 μm absorbs the slight surface asperities in the fixing belt 3, preventing formation of the faulty orange peel image.

Figure 3:
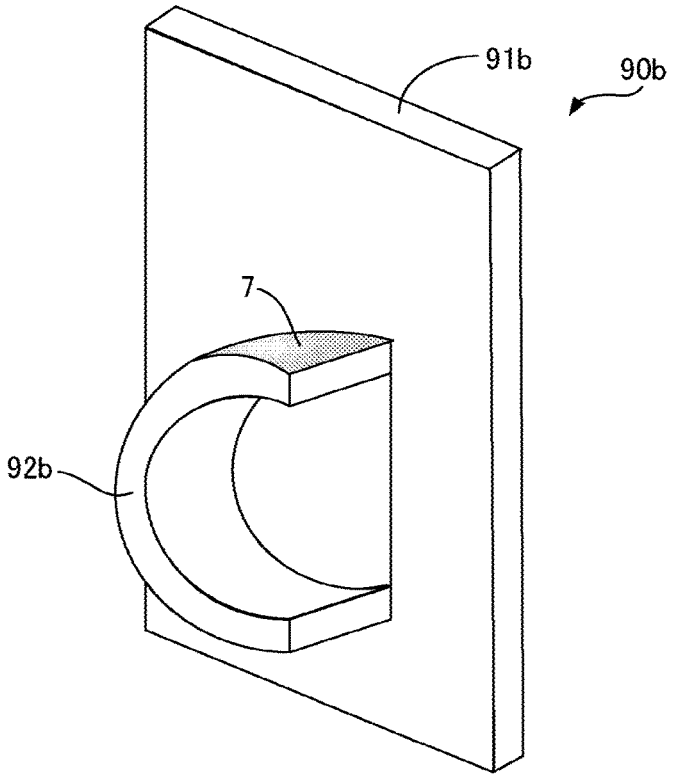
FIG. 3 is a schematic view illustrating a configuration of a flange according to the embodiment of the present disclosure.
Figure 4:
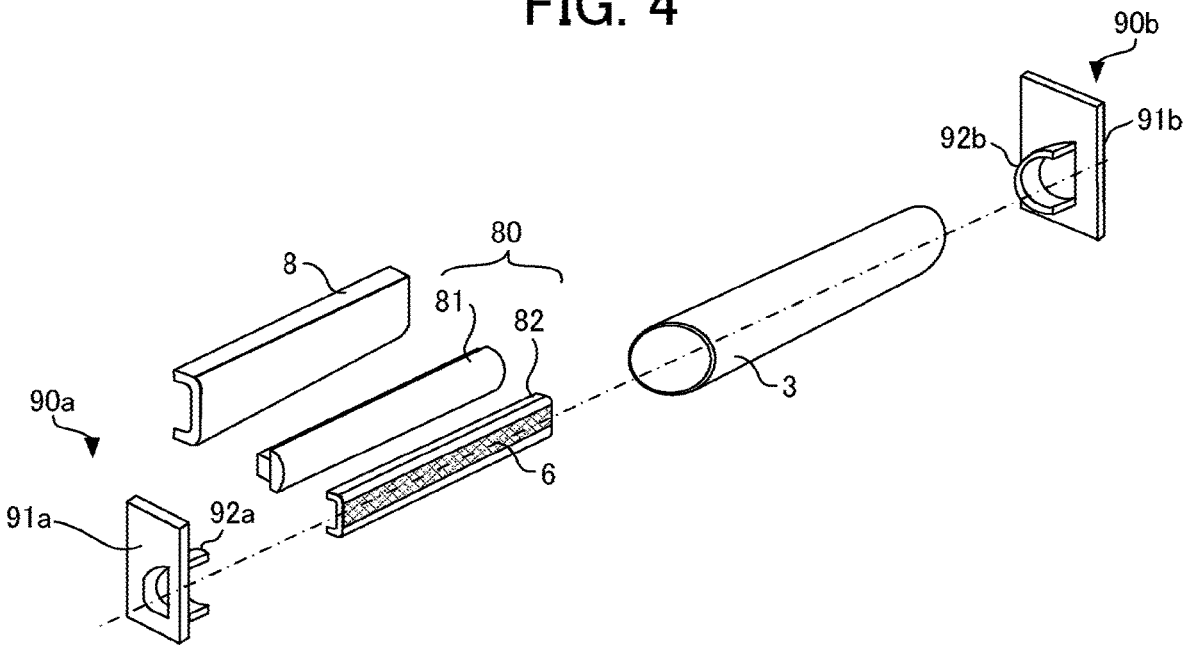
FIG. 4 is an explanatory view illustrating a configuration inside a fixing belt according to the embodiment of the present disclosure.

As illustrated in FIGS. 3 and 4, belt holders 90*a* and 90*b* are inserted into both end portions of the fixing belt 3 in a rotation center axial direction of the fixing belt 3 to maintain an attitude of the fixing belt 3. The belt holders 90*a* and 90*b* include side plates 91*a* and 91*b* and semi-cylindrical portions 92*a* and 92*b* that are projected from the side plates 91*a* and 91*b* to support an inner circumference surface of the fixing belt 3. As described above, the belt holders 90*a* and 90*b* function as flanges that support the end portions of the fixing belt 3.

An end lubricant 7 as a second lubricant is applied to a contact portion on which the fixing belt 3 contacts each of the belt holders 90*a* and 90*b*. In the present embodiment, the end lubricant 7 is silicone oil.

The pressure roller 4 is a cylindrical rotator including a cored bar and an elastic layer formed on the cored bar and having a diameter of about 30 to 40 mm, and a pressure rotator that contacts an outer circumferential surface of the fixing belt 3 to form the fixing nip. The elastic layer is made of a material such as foamable silicone rubber, silicone rubber, or fluororubber. The surface of the elastic layer may include a thin release layer made of PFA, PTFE, or the like.

The pressure roller 4 may be a hollow roller. Alternatively, the pressure roller 4 may include a heat source such as a halogen heater. The elastic layer may be made of solid rubber. Alternatively, if no heater is situated inside the pressure roller 4, the elastic layer may be made of sponge rubber. The sponge rubber is preferable to the solid rubber because the sponge rubber has enhanced thermal insulation and so draws less heat from the fixing belt 3. A driver such as a motor drives and rotates the pressure roller 4 in a clockwise direction in FIG. 2, and this rotation of the pressure roller 4 rotates the fixing belt 3.

The halogen heater 9 is a heat generator disposed inside the loop of the fixing belt 3, and radiant heat from the halogen heater 9 directly heats the inner circumferential surface of the fixing belt 3.

As illustrated in FIG. 4, the nip formation pad 80 includes a thermal equalization plate 82 that contacts the inner circumferential surface of the fixing belt 3 to form the fixing nip and a support 81 disposed on the surface of the thermal equalization plate 82 that is the surface not facing the fixing belt 3. The nip formation pad 80 is disposed inside the loop of the fixing belt 3. A stay 8 as a nip support supports the thermal equalization plate 82 and the support 81. In FIG. 4, for simplification, the respective members are described as being separated from each other, but they are combined as illustrated in FIG. 2.

In the present embodiment, the thermal equalization plate 82 is a concave plate having a surface made of aluminum and coated with fluorine. The thermal equalization plate 82 is not limited to the above-described configuration and may be made of any metal having a high thermal conductivity. Alternatively, the thermal equalization plate 82 may be made of a fiber material to improve slidability. A nip lubricant 6 as a first lubricant is applied to the front side of the thermal equalization plate 82, that is, the portion on which the inner circumferential surface of the fixing belt 3 slides. In the present embodiment, the nip lubricant 6 is fluorine grease.

The support 81 is disposed on the back side of the thermal equalization plate 82 to support the thermal equalization plate 82.

The stay 8 has a shape having a projection projected from a surface of the stay 8 opposite the fixing nip, that is, the surface of the stay 8 different from a surface of the stay 8 facing the fixing nip. Separating from the projection, the halogen heater 9 as the heat source to heat the fixing belt 3 is arranged. In the above-described configuration, the radiant heat from the halogen heater 9 directly heats the inner circumferential surface of the fixing belt 3.

Additionally, in the present embodiment, the belt holders 90*a* and 90*b* support and fix both end portions of the stay 8. Although the nip formation pad 80 receives pressure from the pressure roller 203, the stay 8 supports the nip formation pad 80, prevents bending of the nip formation pad 80, and produces an even nip width on the fixing belt 3 in a sheet conveyance direction indicated by arrow B in FIG. 2 throughout an entire width of the fixing belt 3 in the axial direction thereof. Between the stay 8 and the halogen heater 9, a reflector 209 is disposed to prevent the stay 8 from being heated by the radiant heat from the halogen heaters 9 and reduce wasteful energy consumption. Alternatively, instead of the reflector 209, an opposed face of the stay 8 disposed opposite the halogen heater 9 may be treated with insulation or mirror finish to obtain similar effects.

In the above-described fixing device 200, when the pressure roller 4 is driven to rotate the fixing belt 3, the fixing belt 3 receives sliding friction caused by sliding between a central portion of the inner circumferential surface of the fixing belt 3 and a surface of the thermal equalization plate 82 of the nip formation pad 80 and sliding friction caused by sliding between end portions of the inner circumferential surface of the fixing belt 3 and surfaces of the semi-cylindrical portions 92*a* and 92*b*. Various lubricants are used to reduce the above-described sliding friction.

However, a lubricant generally has a temperature-viscosity characteristic (temperature characteristic) in which the viscosity changes with temperature. The halogen heater 9 heats a central portion of the fixing belt 3 but does not heat the belt holders 90*a* and 90*b* that support end portions of the fixing belt 3 outside an image formation area. As a result, a temperature at each end portion of the fixing belt 3 is lower than a temperature at the central portion of the fixing belt 3. Therefore, using one type of lubricant causes a high viscosity of the lubricant at the end portions of the fixing belt 3 and increases the rotational load of the fixing belt 3. In particular, after the fixing device 200 is placed under a room temperature, for example about 23° C., for a long time and immediately before the first recording medium S passes through the fixing device 200, a temperature difference between the temperature at the end portion of the fixing belt 3 and the temperature at the central portion of the fixing belt 3 becomes largest, and the rotational load of the fixing belt 3 remarkably increases.

The fixing device 200 according to the present embodiment includes two types of lubricants having different temperature-viscosity characteristics, that is, the nip lubricant 6 applied between the nip formation pad 80 and the inner circumferential surface of the fixing belt 3 and the end lubricant 7 applied between each of the belt holders 90*a* and 90*b* and the inner circumferential surface of the fixing belt 3.

The two types of lubricants are described in more detail.

Figure 5:
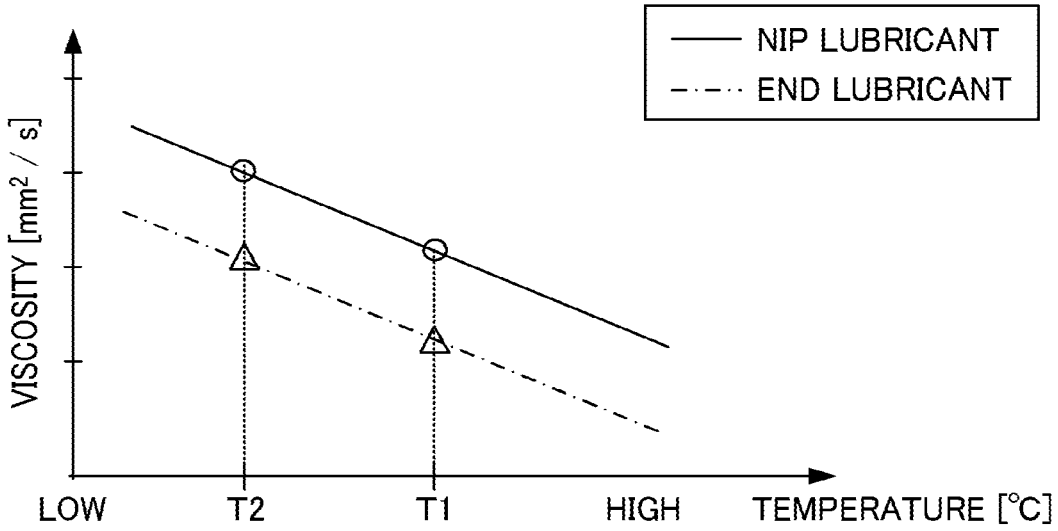
FIG. 5 is a graph illustrating examples of temperature characteristics of a plurality of lubricants used in the fixing device.

FIG. 5 is a graph illustrating temperature-viscosity characteristics of the nip lubricant 6 and the end lubricant 7 that are used in the present embodiment. In FIG. 5, the temperature T1 is a temperature at a central portion of the fixing nip, as a temperature of the fixing nip during operation of the fixing device, and the temperature T2 is a temperature at an end portion at which each of the belt holders 90*a* and 90*b* contacts the fixing belt 3, as a temperature of the flange during operation of the fixing device. In the above, specifically, "during operation of the fixing device" includes a time when a temperature of the fixing belt 3 reaches a control target temperature after the halogen heater 9 starts heating the fixing belt 3.

As is clear from FIG. 5, under the temperatures T1 and T2 in the fixing device 200 during operation of the fixing device, the viscosity of the end lubricant 7 is equal to or smaller than the viscosity of the nip lubricant 6. In the above-described configuration, the smaller viscosity of the end lubricant 7 than the viscosity of the nip lubricant 6 can prevent increase in the rotational load at the end portion of the fixing belt 3 at which the temperature is lower than the fixing nip.

The viscosity of the end lubricant 7 at the temperature T2 of the flange during operation of the fixing device is preferably as close as possible to the viscosity of the nip lubricant 6 at the temperature T1 of the fixing nip during operation of the fixing device because the difference between the sliding friction at the end portion and the sliding friction at the central portion decreases.

Figure 6:
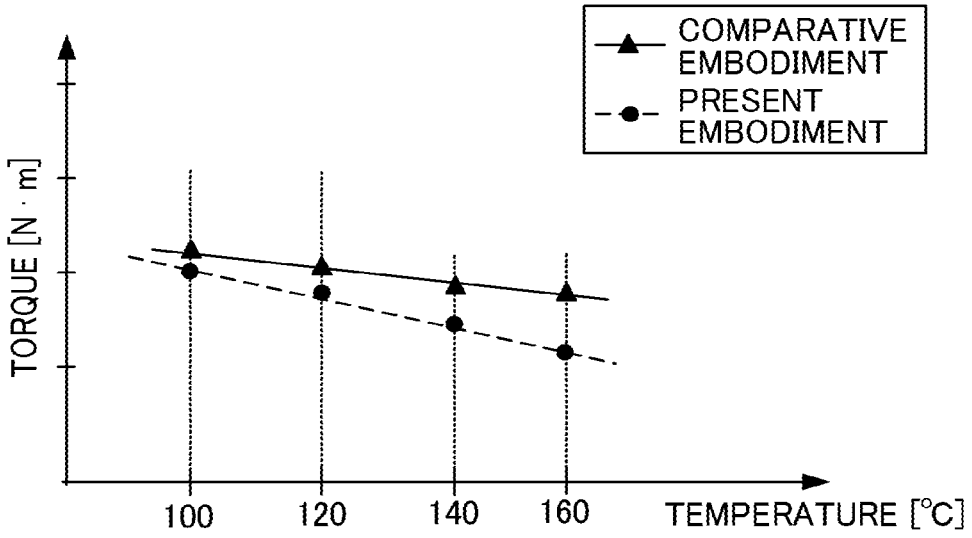
FIG. 6 is a graph illustrating a difference in rotational load between the present embodiment and a comparative example.

FIG. 6 is a graph illustrating a temperature-rotational torque characteristic of the fixing device 200 using the nip lubricant 6 and the end lubricant 7 as described above, which is drawn by a broken line, and a temperature-rotational torque characteristic of the fixing device of a comparative example using one type of lubricant, which is drawn by a solid line. FIG. 6 illustrates experimental results. The temperatures in the X-axis is control temperatures at the fixing nip. In FIG. 6, when the control temperature at the fixing nip is relatively small, that is, in the vicinity of 100° C., the difference in the rotational torque between the present embodiment and the comparative example is small. However, as the control temperature increases, the difference in the rotational torque increases clearly.

As described above, using two types of lubricants having different temperature-viscosity characteristics, that is, the nip lubricant 6 and the end lubricant 7 in the present embodiment can eliminate a factor of torque increase caused by the temperature difference between the end portion of the fixing belt and the central portion of the fixing belt.

Since the above-described configuration can prevent the rotational torque from increasing and reduce the rotational load applied to the fixing belt 3, the above-described configuration contributes to extending the life of the fixing device.

Next, a second embodiment of the present disclosure is described. In the second embodiment, the viscosity of the nip lubricant 6 is smaller than the viscosity of the end lubricant 7 applied to the flange under the temperature during operation of the fixing device 200. Other parts are the same as the first embodiment.

In the above, the end lubricant 7 having a high viscosity under the temperature during operation of the fixing device is applied to both end portions of the fixing belt 3 and can prevent the nip lubricant 6 having a low viscosity from leaking out from the central portion of the fixing belt 3. Preferably, the nip lubricant 6 is fluorine grease having a converted viscosity about ten times the converted viscosity of the end lubricant 7, and an amount of the nip lubricant 6 applied to 1 cm2 is about two times an amount of the end lubricant 7 applied to 1 cm2.

Numerous additional modifications and variations are possible in light of the above teachings. It is therefore to be understood that, within the scope of the above teachings, the present disclosure may be practiced otherwise than as specifically described herein.

For example, one halogen heater 9 is used in the present embodiment, but the fixing device may include a plurality of halogen heaters.

The flange in the present embodiment is the belt holder. However, the flange may have various shapes as long as the flange supports the end portion of the belt.

As described above, the fixing device according to the present embodiment has an effect of reducing the rotational load of the fixing belt sliding on something. Therefore, the fixing device according to the present disclosure can be applied to a fixing device including a fixing member sliding on something and an image forming apparatus including the fixing device.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device, comprising:

a flexible endless belt;

a pressure rotator disposed outside the belt and facing the belt;

a nip formation pad disposed inside a loop of the belt and configured to form a fixing nip between the belt and the pressure rotator;

a heater to heat a central portion of the belt in an axial direction of the belt;

a flange to support an end portion of the belt in the axial direction, wherein the heater does not directly heat the flange and the end portion of the belt so that a second temperature of the end portion of the belt is lower than a first temperature of the central portion of the belt;

a first lubricant applied between the nip formation pad and an inner surface of the belt;

a second lubricant applied between the flange and the inner surface of the belt, the second lubricant having a temperature-versus-viscosity curve that is different from a temperature-versus-viscosity curve of the first lubricant, wherein, under the first temperature of the central portion and the second temperature of the end portion in the fixing device in operation, a viscosity of the second lubricant is equal to or smaller than a viscosity of the first lubricant.

2. The fixing device according to claim 1, wherein the first lubricant is fluorine grease.

3. The fixing device according to claim 1, wherein the second lubricant is silicone oil.

4. An image forming apparatus comprising:

an image forming device configured to form an image;

a transfer device configured to transfer the image to a recording medium; and the fixing device according to claim 1 configured to fix the image on the recording medium.

* * * * *